US006040751A

United States Patent [19]

Haehnel et al.

[11] Patent Number: 6,040,751

[45] Date of Patent: Mar. 21, 2000

[54] BATTERY SECTION SWITCH

[75] Inventors: Thomas Haehnel; Juergen Breitlow-Hertzfeldt, both of Berlin; Bernd Saffian, Brandenbueg; Josef Kern, Berlin, all of Germany

[73] Assignee: Siemens Electromechanical Components GmbH & Co. KG, Munich, Germany

[21] Appl. No.: 09/358,146

[22] Filed: Jul. 20, 1999

[30] Foreign Application Priority Data

Jul. 20, 1998 [DE] Germany ..... 198 32 573

[51] Int. Cl.[7] ..... H01H 3/00

[52] U.S. Cl. ..... 335/185; 335/177; 335/189; 335/220

[58] Field of Search ..... 335/177–179, 335/220, 229, 185, 186, 187, 189, 191, 195

[56] References Cited

U.S. PATENT DOCUMENTS 5,568,113 10/1996 Chen ..... 335/195

5,612,659 3/1997 Kerber ..... 335/177

FOREIGN PATENT DOCUMENTS 197 01 933 2/1998 Germany .

*Primary Examiner*—Lincoln Donovan
*Assistant Examiner*—Tuyen T. Nguyen
*Attorney, Agent, or Firm*—Hill & Simpson

[57] ABSTRACT

The battery section switch is switched between a terminal post and a main circuit using a contact arrangement. The contact arrangement can be locked in its closed position via a toggle spring device that acts directly on a free end of a contact spring. The toggle spring device is also coupled to the armature of an electromagnet system which, given excitation, releases the interlock and opens the contact arrangement. Given this battery section switch, the on-board network of a vehicle can be quickly switched current-free, given a collision or given a short-circuit, in order to reduce the risk of fire or in order to prevent a discharge of the battery given some other malfunction.

16 Claims, 10 Drawing Sheets

BATTERY SECTION SWITCH

BACKGROUND OF THE INVENTION

The present invention is directed to a section switch for the load circuit of a vehicle battery. More particularly, the present invention is directed to section switches for the load circuits of vehicle batteries of the type having the following features: a housing; an electromagnetic system with an armature arranged in the housing; an input lead connectable to a terminal post; an output lead connectable to the load circuit; a stationary and a movable contact for producing a switched connection between the input lead and the output lead; a contact carrier that carries the movable contact, is switchable between an opening position and a closing position, and is biased into the opening position by spring power; and a toggle spring device having a first lever attacking at the contact carrier and a second lever seated in the housing that are connected via a central link to form a toggle that, in an approximately stretched condition, locks the contact carrier in its closed position; whereby the armature is coupled such to the toggle that it releases the lock between the toggle and the contact carrier given excitation of the magnet system.

A section switch of the above type is disclosed in German Patent No. 197 01 933. This known section switch uses a contact rocker as contact carrier that is rotatably seated in the housing and that carries the movable contact indirectly via a contact spring acting as lever arm. For restoring the contact rocker into the open position, an additional tear spring is provided therein.

SUMMARY OF THE INVENTION

It is an object of the present invention to create a battery section switch having the initially cited structure and having a simple and compact design with especially few discrete parts and that can thereby be even more economically manufactured. The battery section switch should automatically disconnect the battery from the load circuit at least upon occurrence of a predetermined situation, for example when a short-circuit sensor or an impact sensor responds, but should also be able to assume additional functions on the basis of appropriate fashioning, for example the possibility of a manual disconnect or, for instance, an inhibit to reactivation when a short-circuit continues to last. It should be capable of being attached directly to a battery terminal of a vehicle on the basis of its design.

This object is inventively achieved in accordance with the invention in a battery section switch having a contact carrier that is an elongated contact spring, clamped at one end in the housing, that carries the movable contact in the middle region of its length and interengages at its free (movable) end with the outer end of the first toggle lever to form a rotary coupling.

Given the inventive battery section switch, a contact spring, i.e. a low profile spring, is clamped directly at the housing as contact carrier, so that additional rocker elements or bearing parts are not required. The contact spring generates the separating force itself due to its spring prestress and has its free end coupled directly to the toggle, so that a simple embodiment with few parts is possible.

It can thereby be provided in the simplest way that the armature of the electromagnetic system acts via an actuation arm directly on the toggle, perpendicular to the extended axis thereof or on the middle toggle link and pulls this over the dead point given excitation of the magnet system, after which the contact spring released in this way opens the contact.

In order to achieve a sudden switch behavior when closing the contact, which usually ensues manually, the contact spring can be non-positively or positively retained in its open position by a supporting spring or a supporting lever, so that the contact-carrying middle part of the contact spring is released and suddenly closes the contact only after overcoming a predetermined friction or a predetermined sag of the free spring end.

In order to enable a manual opening of the section switch, for example, pressure can be exerted directly onto the middle toggle link via a key seated in the housing in order to move this beyond the dead point and open the contact. Preferably, however, a switch lug in the form of a lengthened portion is applied to the second toggle lever, or a rotatory element rigidly or movably coupled to the second lever arm is provided that enables manual turn-off and/or turn-on.

Further details, developments and improvements of the invention are explained in greater detail below with reference to exemplary embodiments on the basis of the drawing.

DESCRIPTION OF THE PRESENTLY PREFERRED EMBODIMENTS

Figure 1:
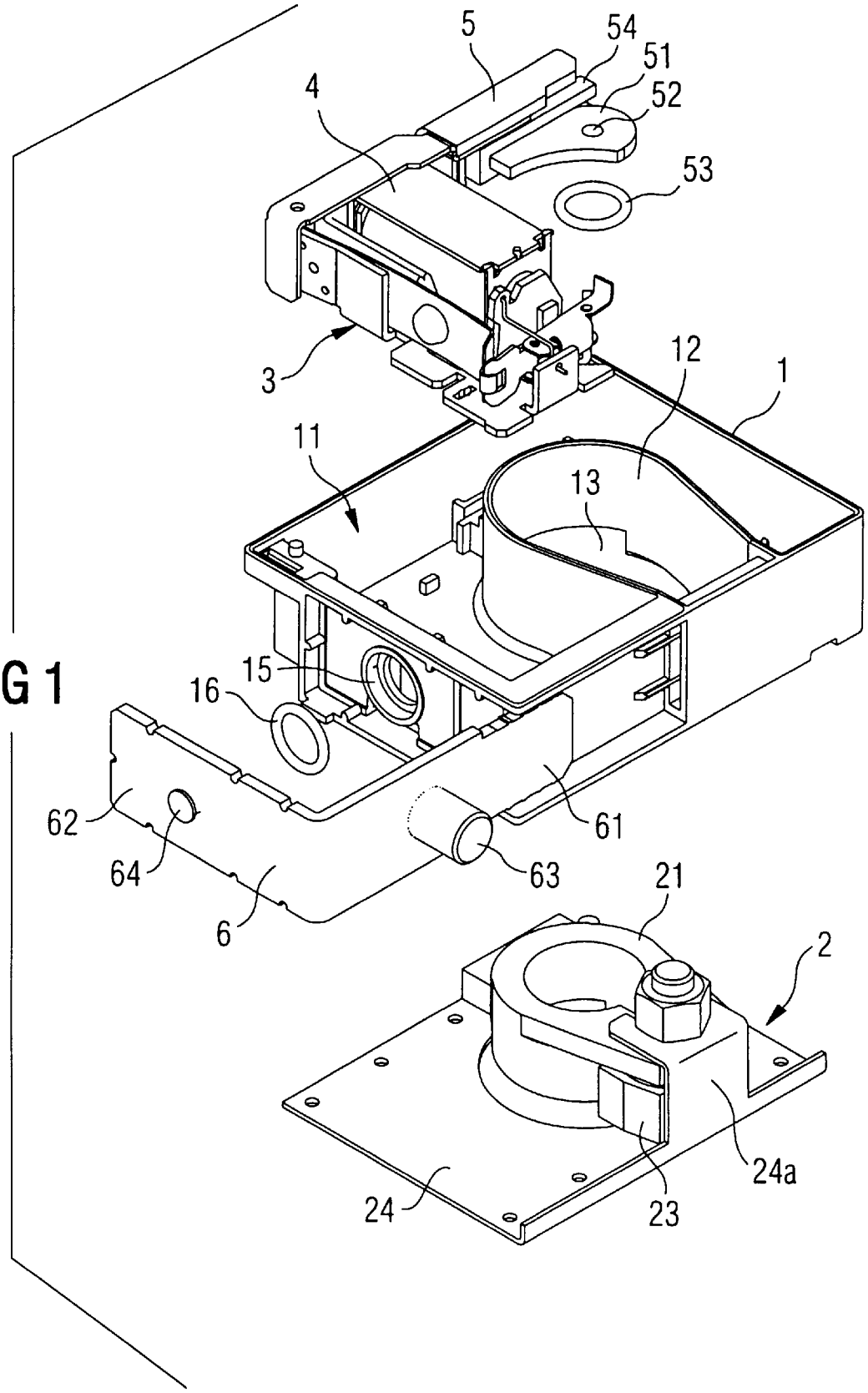
FIG. 1 is a perspective view of the individual assemblies of a battery section switch constructed and operated in accordance with the invention.
Figure 2:
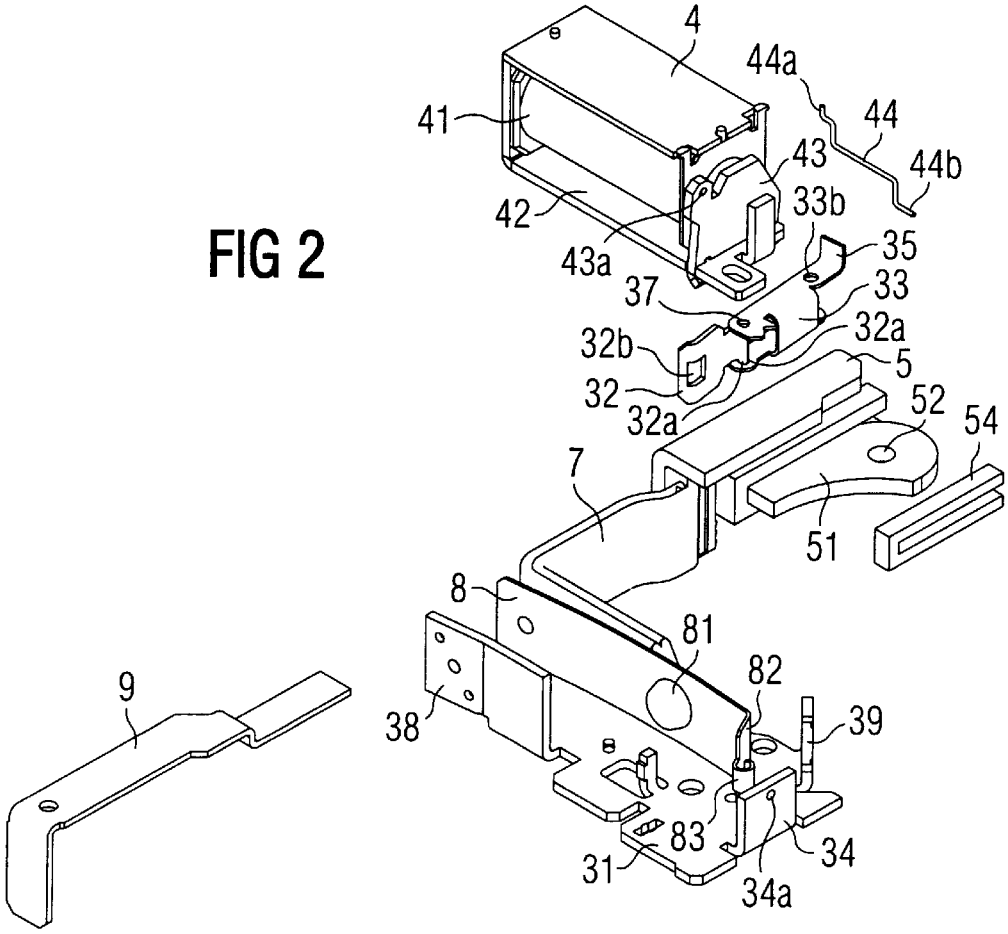
FIG. 2 is a perspective view of the spring device assembly with electromagnet system of the battery section switch of FIG. 1 shown partially assembled.
Figure 3:
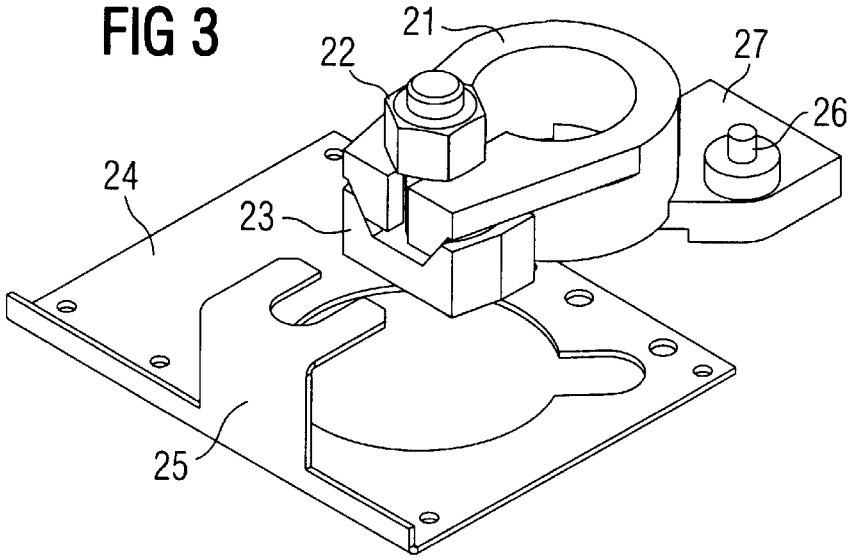
FIG. 3 is a perspective view of the terminal post assembly of FIG. 1 shown partially assembled.

Referring to FIGS. 1 through 5, the inventive battery section switch has an especially simple structure. It is accommodated in a plastic housing 1 that is connected to a terminal post assembly 2. A spring device assembly 3 that interacts with an electromagnet system 4 is introduced into the plastic housing 1 from above. Moreover, an input lead 5 and an output lead 6 are plugged into the plastic housing 1.

Figure 5:
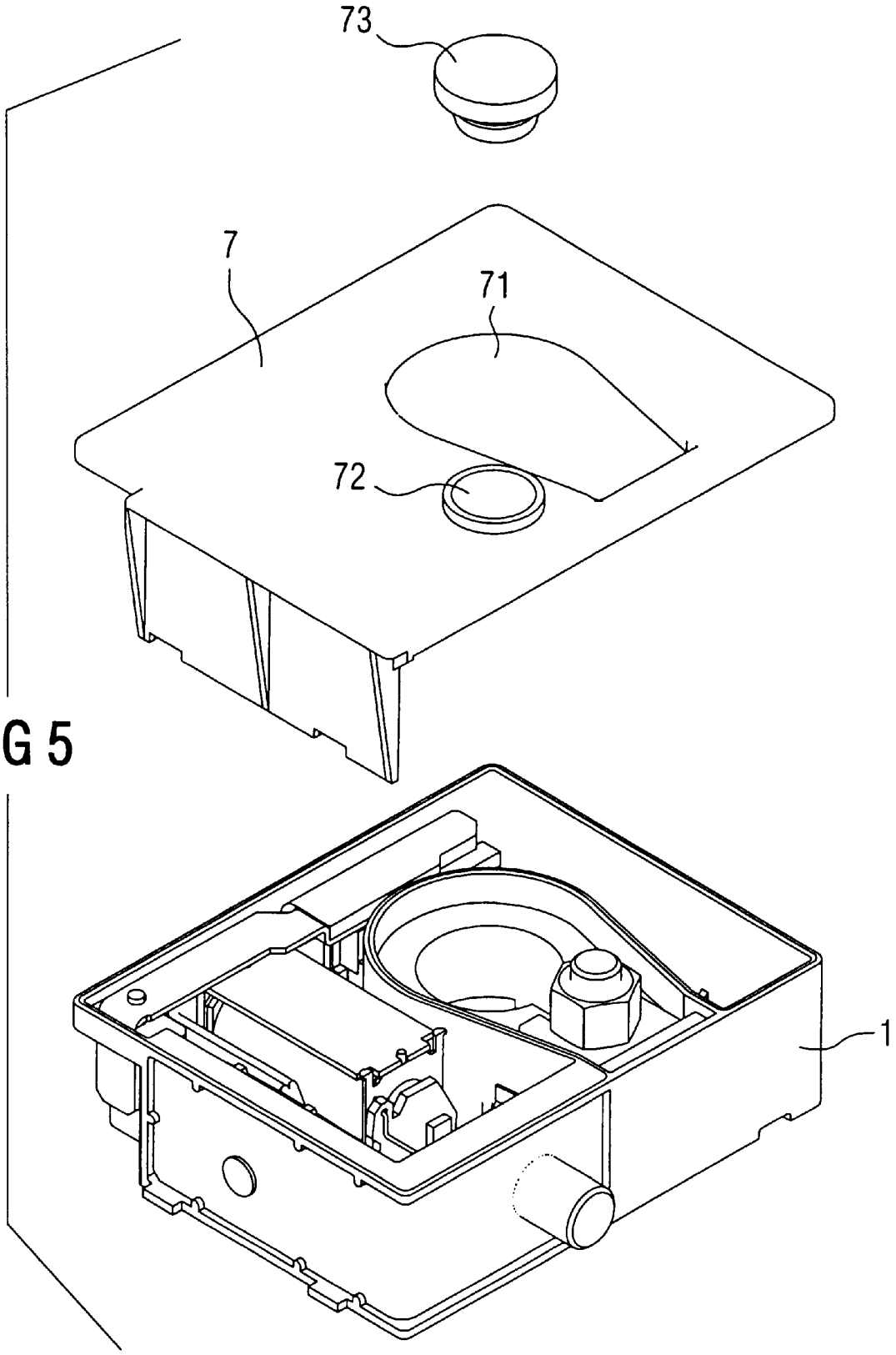
FIG. 5 is a perspective view of the battery section switch of FIG. 1 in its assembled condition but with open cover.

Finally, the plastic housing 1 can be tightly closed with a cover 70 proceeding from an upper side (FIG. 5).

The plastic housing 1 has a switch chamber 11 limited by a bottom plate and side walls, this switch chamber 11 accepting the functional parts of the section switch. Further, a space 13 for the acceptance of a terminal post 21 is recessed within the plastic housing 1 by a curved partition 12. Since the cover 70 also comprises a corresponding recess 71, the closed and sealed plastic housing 1 with the section switch can be placed onto a battery pole (not shown) with the terminal post 21 such that the terminal post or a corresponding post screw 22 remains accessible from the outside. The terminal post 21 interacts with a post shoe 23 that is riveted to a base plate 24 of sheet metal. At its front end, the base plate 24 has a U-bend 25 lying on the terminal post 21, where it is fixed via the post screw 22. The plastic housing 1 is placed onto the base plate 24 and heat-coined, as a result whereof the entire battery section switch is supported on the terminal post 21 at both sides. For better transverse stiffening, the base plate 24 also has a through, perpendicular bent-off section at its front end.

A round peg 26 is cast to an extension 27 of the terminal post shoe 23, this peg 26 projecting upward through the plastic housing 1 into the switch chamber 11. Battery current is conducted via this peg 26 into the inside of the battery section switch onto the inwardly riveted input lead 5. This input lead 5 is composed of sheet copper and is bent U-shaped. One leg 51 has a round hole 52 plugged onto the peg 26 and riveted. The round cross section of the peg 26 is thereby sealed off from the floor of the plastic housing 1 water-tight by an O-ring 53. A ferrite ring 54 is also arranged at the leg 51 of the input lead 5, a current sensor, preferably a hall sensor, for monitoring the battery current being inserted into a slot of said ferrite ring 54 (not shown). For example, a short can thus be detected, this being employed as a pulse for shutting off the battery section switch. The current sensor (not shown) can thereby be directly soldered on a printed circuit board (not shown) that is perpendicularly installed. The electronics of such a printed circuit board (not shown) serve, for example, for evaluation of the short-circuit signal or, additionally, for displaying a battery current detected via the current sensor (not shown) for battery management.

A stranded conductor 7 for forwarding the current to a movable contact 81 is welded on a perpendicularly bent leg of the input lead 5. This movable contact 81 is secured in a contact spring 8 that is clamped rigidly relative to the plastic housing 1. The stranded conductor 7 consists of two flat stranded conductors placed above one another, as a result whereof good flexibility in actuation direction of the contact 81 is assured given large conductor cross sections. The contact spring 8 is implemented as a low profile spring clamped at one side. The contact opening force, the contact path as well as the contacting force and the excess stroke are exerted via this one contact spring 8. This one contact spring 8 thereby assumes the functions of a contact spring, of a restoring spring and of a contact rocker. The movable contact 81 is secured roughly in the middle of the free spring length of the contact spring 8. The free spring end 82 is bent off and shaped to form a hook 83 with which the contact spring 8 is in engagement with the spring device.

The spring device assembly 3 is composed of a toggle spring device that is arranged on a carrier plate 31. The contact spring 8 is secured to a perpendicular, upwardly bent tab 38 of the carrier plate 31. Further, a quadratic peg 39 is bent perpendicularly up from the carrier plate 31, this serving as pivot point for the spring device, which is rigidly arranged relative to the plastic housing 1. A toggle of the spring device is formed by two correspondingly bent sheet metal parts, namely a first lever 32 and a second lever 33. Two articulated pegs 32*a* are cut free at the first lever 32, these lying in articulation holes 33*a* of the second lever 33 bent U-shaped and forming a middle toggle link 37 with this. The second toggle 33 has further articulation holes 33*b* with which this second lever 33 is seated on the quadratic peg 39. The first lever 32 also has an eye-shaped recess 32*b* at its outer end, i.e. its end facing away from the middle toggle link 37, wherein the eye-shaped recess 32*b* engages with the hook-shaped end section 83 of the contact spring 8. The respective articulation pegs 32*a* or the eye-shaped recess 32*b* of the first lever 32 respectively have their edges lying in the articulation holes 33*a* of the second lever 33 as well as in the hook-shaped end section 83 of the contact spring during the tensed condition of the toggle. At the moment of triggering when the middle toggle link 37 is pulled beyond the dead point, these act like a knife-edge bearing, as a result whereof the bearing friction is extremely low at the moment of triggering and requires only a slight trigger force.

The electromagnet system 4 has a coil 41 with a core and a yoke 42 at whose free end an armature 43 is seated in the form of a cutout blade. A crimped setting wire 44 is provided for coupling between the armature 43 and the toggle 32, 33, this setting wire 44 having one end 44*a* hooked into a bore 43*a* of the armature 43 and having its other end 44*b* conducted in a bore 34*a* of an upwardly bent tab 34 of the carrier plate 31. The setting wire 44 has a crimped shoulder of the wire end 44*b* lying in a flute 33*c* of the second lever arm 33 in the proximity of the middle toggle link 37. The tab 34 of the carrier plate 31 also serves as seating edge of the toggle spring device in the tensed condition. The first lever 32 thereby presses the setting wire 44 against a seating edge of the tab 34 with the flute 33*c*.

For triggering the spring device, the armature 43—given excitation of the magnet system—pulls the second lever 33 away from the tab 34 beyond the dead point via the setting wire 44; subsequently, the toggle is completely pressed through due to the restoring force of the contact spring 8. As a result of self-resiliency of the setting wire 44, the full trigger force does not act on the armature 43 at the start of the armature 43 stroke, so that this need only overcome the lower spring force of the setting wire 44 at the beginning of the switch movement until the electromagnet system 4 has built up sufficient force to trigger the spring device.

A switch lug 35 is bent upward on the second lever 33 at the quadratic peg 39 behind the rotary coupling that is rigid relative to the plastic housing 1. The switch lug 35 projects upward through a hole 72 in the cover 70 or is accessible from the outside and thus serves for manual turn-on and turn-off. The switch lug 35 can be knocked over with the assistance of a screwdriver or a similar tool in order to again tense the toggle and in turn to close the contact spring (manual reactivation after electrical triggering). Conversely, however, a manual shut-off is also possible. The switch lug 35 lies within a pass-through region in the cover 70 that can be sealed off from the outside with a closure plug 73. This closure plug 73 can also be sealed in order to prevent a reactivation when a short-circuit continues to last. In this case, it is assured that it is not the user of a vehicle but only garage personnel that can reactivate the load circuit after elimination of the short or a check of the circuit.

The aforementioned output lead 6 is secured to the outside of the plastic housing 1. This is implemented L-shaped, whereby a first leg 61 is secured via a sawtooth contour in a corresponding pocket at the outside of the plastic housing 1, whereas a second leg 62 is fixed to the plastic housing 1 by heat-coining. As a result of this fixing, the forces of a battery cable screwed to the output lead 6 via a bolt 63 are absorbed. At the same time, the L-shaped bending of the output lead 6 stiffens the entire plastic housing 1. A fixed contact 64 that projects through a round opening 15 into the interior of the plastic housing 1 is secured to the second leg 62 from the inside. The round opening 15 for this fixed contact 64 is sealed with an 0-ring 16, so that the plastic housing 1 is also closed water-tight at this location. The fixed contact 64 is composed, for example, of a round copper part with contact material that has been plated on or welded on.

An additional emergency current terminal 9 is also arranged at the plastic housing 1 and is connected to the input lead 5. It serves the purpose of maintaining emergency circuits, for example for a blinker system, as well as triggering the battery section switch.

Figure 4:
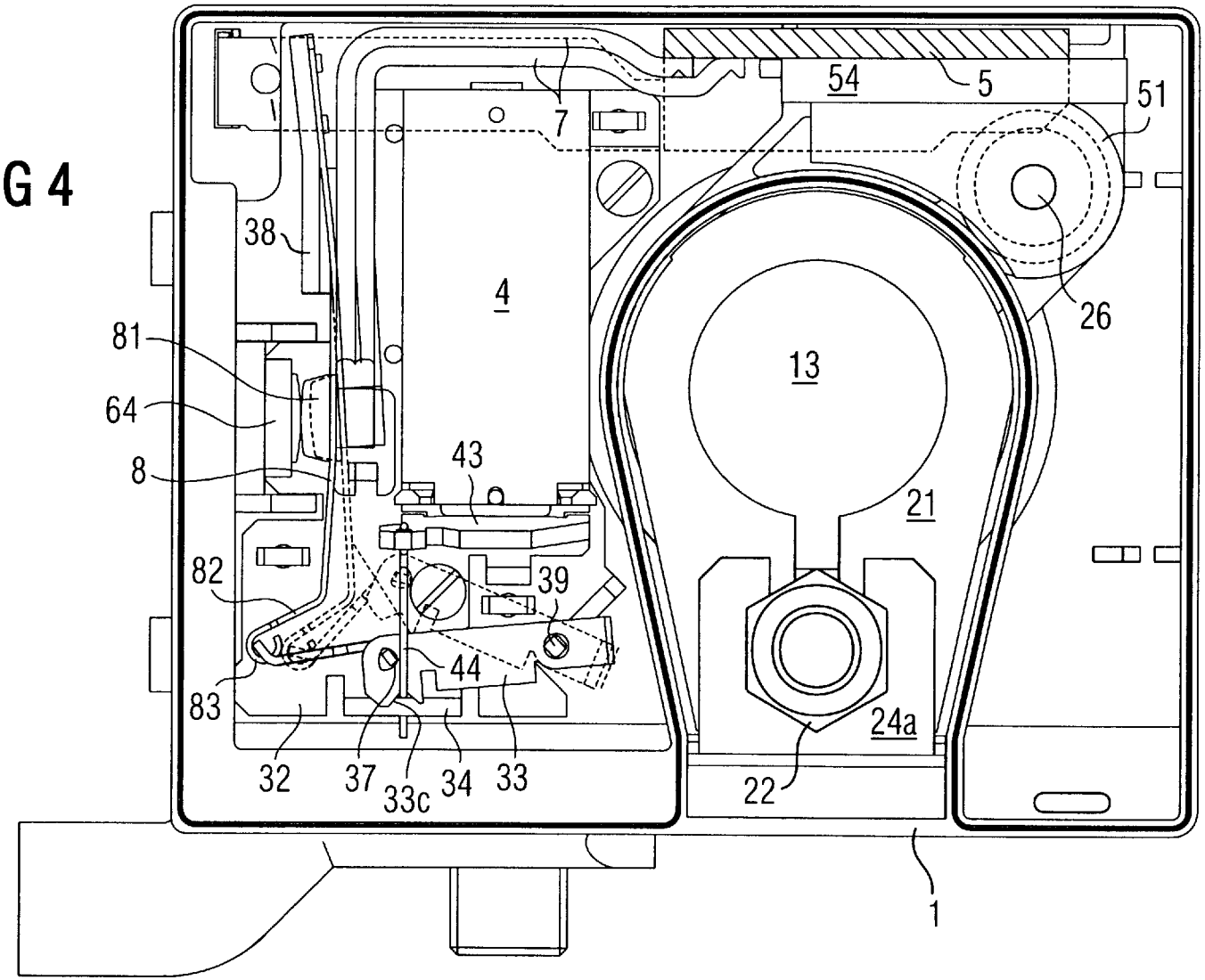
FIG. 4 is a plan view onto the battery section switch of FIG. 1.

The function of the battery section switch shall be set forth in brief again below. In the quiescent condition, the toggle is tensed, whereby the middle toggle link 37 is pressed slightly beyond the dead point toward the outside, and the second lever 33 lies against the tab 34. This condition is shown in FIG. 4.

The contact spring 8 is thereby pressed into the closed position opposite its pre-stress, wherein the movable contact 81 lies on the fixed contact 64. Given excitation of the electromagnet system 4, the armature 43 attracts and displaces the middle toggle link 37 beyond the dead point via the setting wire 44. Beyond the dead point position, the toggle is deflected with the contact and tearing force of the contact spring 8 that now becomes free and the spring contact is opened. The contact spring 8 and the toggle 32, 33 then assume the position shown with broken lines in FIG. 4.

Due to the translation via the toggle spring device, the high contact and tearing forces of the contact spring 8 can be deactivated with relatively low trigger forces and, thus, small electromagnets, whereby the frictional force part is slight. Instead of the cutout blade magnet system, of course, a solenoid plunger system can also be employed; this, however, would have a greater armature mass and would thus be more susceptible to impacts. For manual reactivation, the toggle must be re-tensed, whereby the second lever 33 is moved into the quiescent position with the switch lug 35, as described above.

The above-described basic structure of a battery section switch also applies to the following versions that respectively contain modifications in the design of the toggle spring device and the coupling thereof to the contact spring 8 as well as the electromagnet system 4. FIGS. 6 through 11 as well as 14 and 15 thereby only respectively show partial views in plan view, and only those parts that differ from the first exemplary embodiment are described. Insofar as other structural parts exhibit modifications, these are of no significance for the invention.

Figure 6:
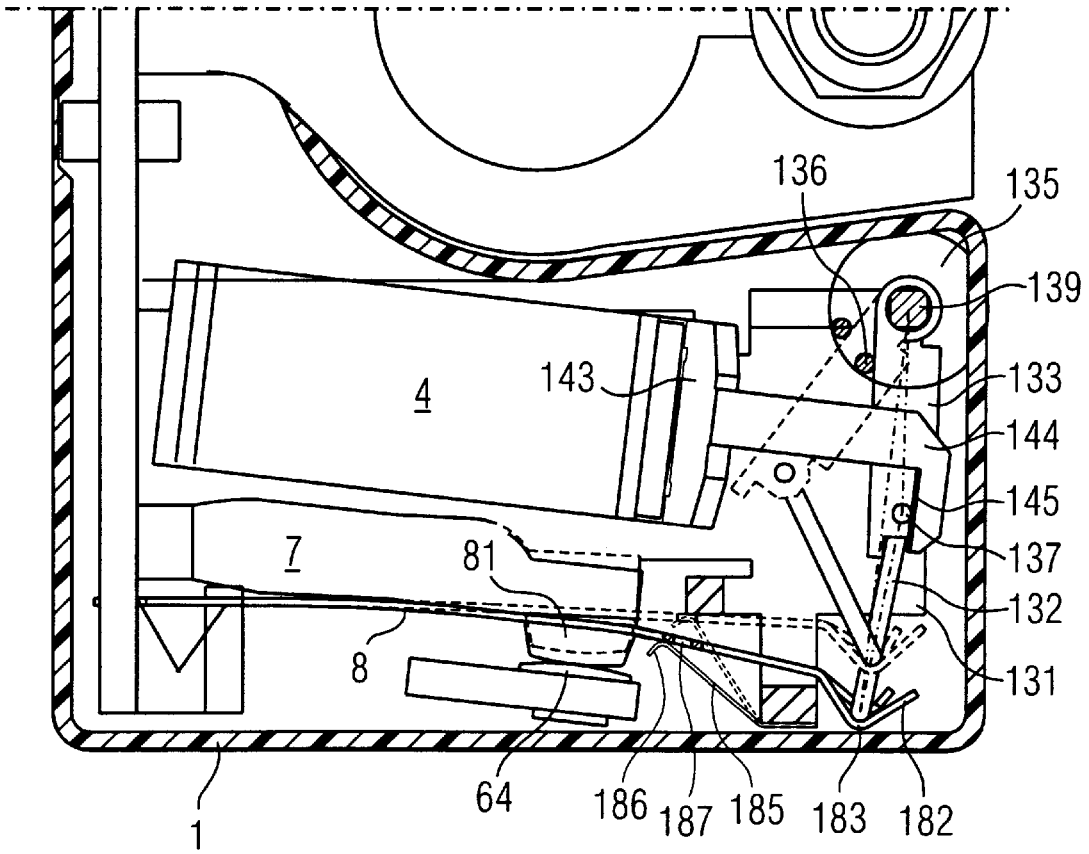
FIG. 6 is a plan view of a second embodiment of the battery section switch.

FIG. 6 describes an exemplary embodiment wherein a modified toggle is formed of a first lever 132 and a second lever 133 that are seated inside one another to form a middle toggle link 137. The second toggle 133 is seated at a quadratic peg 139 upturned from a carrier plate 131, which is rigid with respect to the plastic housing 1. A rotary knob 135 is also seated on the same quadratic peg 139 and concentric relative to the first lever 133. This rotary knob 135 has an eccentric dog 136. Given manual, counter-clockwise rotation, this dog 136 acts directly on the second lever 133 and thus tenses the toggle, which is thereby moved slightly beyond the dead point and then lies against a seating edge 145 of a boom 144 of the armature 143. This boom 144 is implemented of one piece with the armature 143 in the present example. The first lever 132 has its outer end lying in an indented portion 183 of the contact spring 8 and thus forms an outer toggle link. As a result of a fanning of the free spring end 182 of the contact spring 8, whereby a middle spring leg 181 is bellied into a greater extent than the outer spring legs 184, the first lever 132 is also laterally secured in the bearing.

FIG. 6 also shows a supporting spring 185 that is secured to a support tab 193 of the carrier plate 131 and that has its bent at its free end 186 lying in a recess 187 of the contact spring 8 when this is in the open condition (broken-line illustration). The result thereof is that, when the toggle link is tensed, the supporting spring 185 holds the contact spring 8 in its quiescent position until a limit force is overcome, with the bent end 186 of the supporting spring 185 jumping out of the recess 187 thereat after overcoming the friction and releasing the contact spring 8. The contacts 81 and 64 are suddenly closed with this released force independently of the switch position. Given electrical separation of the contacts 81 and 64, by contrast, the contact tearing force is supported with the supporting spring 185.

Figure 7:
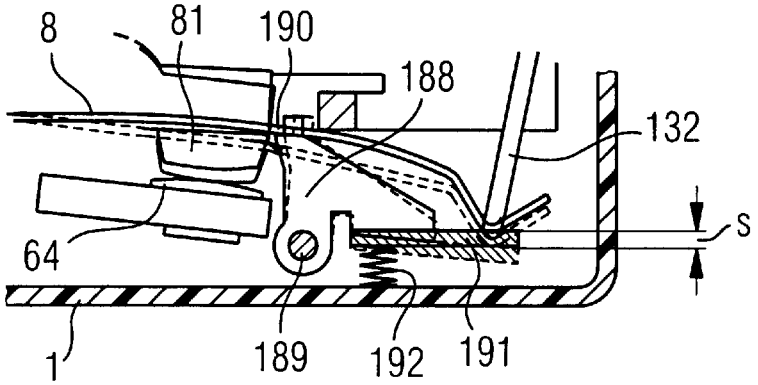
FIG. 7 shows a portion of FIG. 6 with a modified fashioning of the contact area.

Another possibility for producing a discontinuous characteristic is shown excerpted in FIG. 7. In this embodiment, an additional supporting lever 188 is seated on the carrier plate 131 via a rotary coupling 189. In the open condition of the contact spring 8, a lever latch 190 applied to the supporting lever 188 engages at a perforated edge of the contact spring 8 and retains this in the quiescent position, even during tensing of the toggle. Only when the lever 132 has pressed the end 182 of the contact spring 8 through to such an extent that this presses against the end 191 of the supporting lever 188 is this supporting lever 188 swivelled clockwise with the remaining switch stroke s so that it releases the contact spring 8 and enables a sudden closing of the contacts 81 and 64. Upon return of the contact spring 8 into its quiescent position (triggering of the battery section switch), the supporting lever 188 is brought into its locking position by a restoring spring 192.

There are various possibilities for also producing a manual shut-off with discontinuous behavior. For example, a pushbutton (not shown) can be inserted, this pressing against the middle toggle link 137 like the armature boom 144 and triggering the spring device. However, the rotary knob 135 can also be implemented such that, given reverse rotation (counter-clockwise) beyond the quiescent position, it seizes the second lever 133 with the eccentric dog 136 from the opposite side and thus triggers the spring device.

Figure 8:
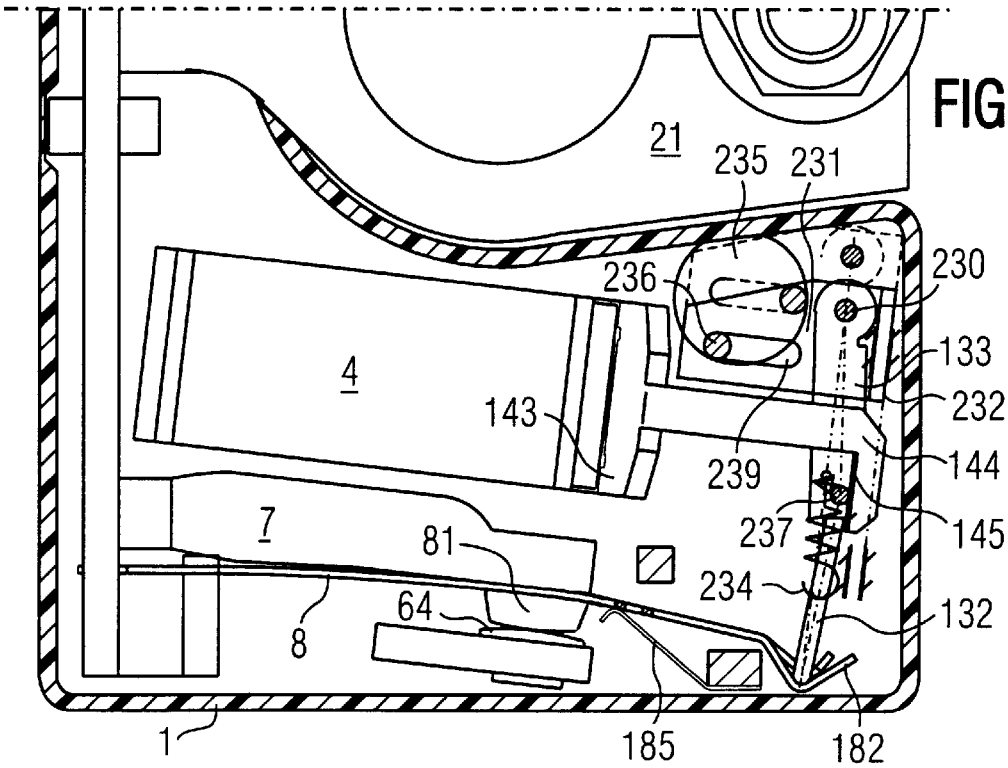
FIG. 8 is a plan view of a third embodiment of the battery section switch shown in quiescent position.
Figure 9:
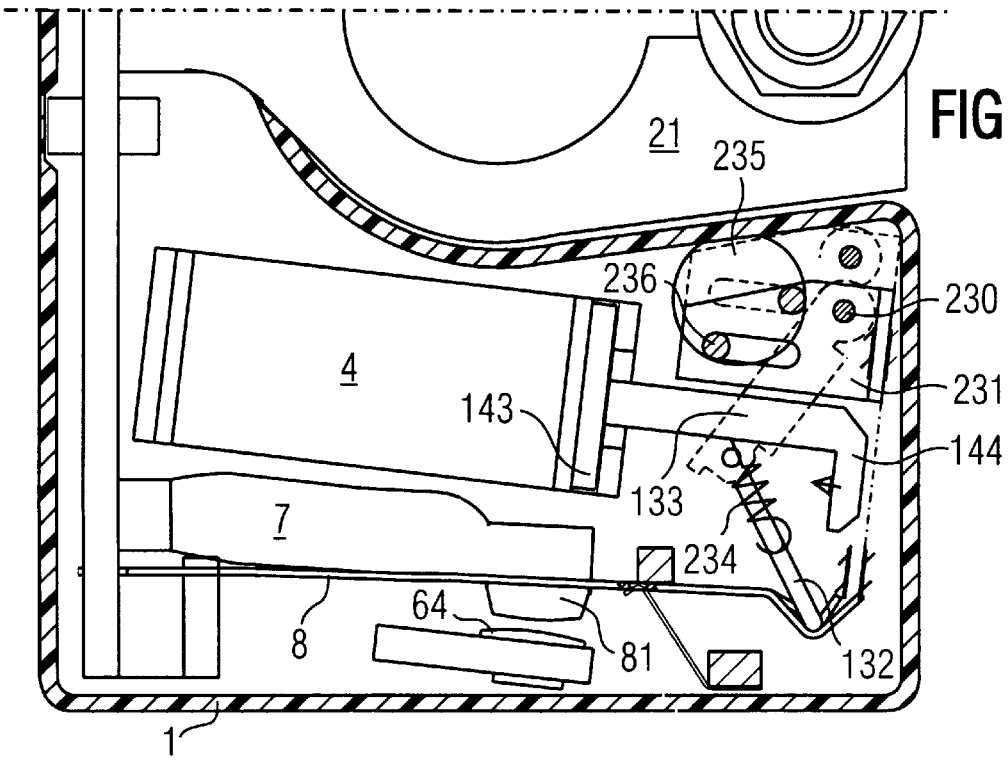
FIG. 9 is a plan view of a third embodiment of the battery section switch shown in triggered position.
Figure 10:
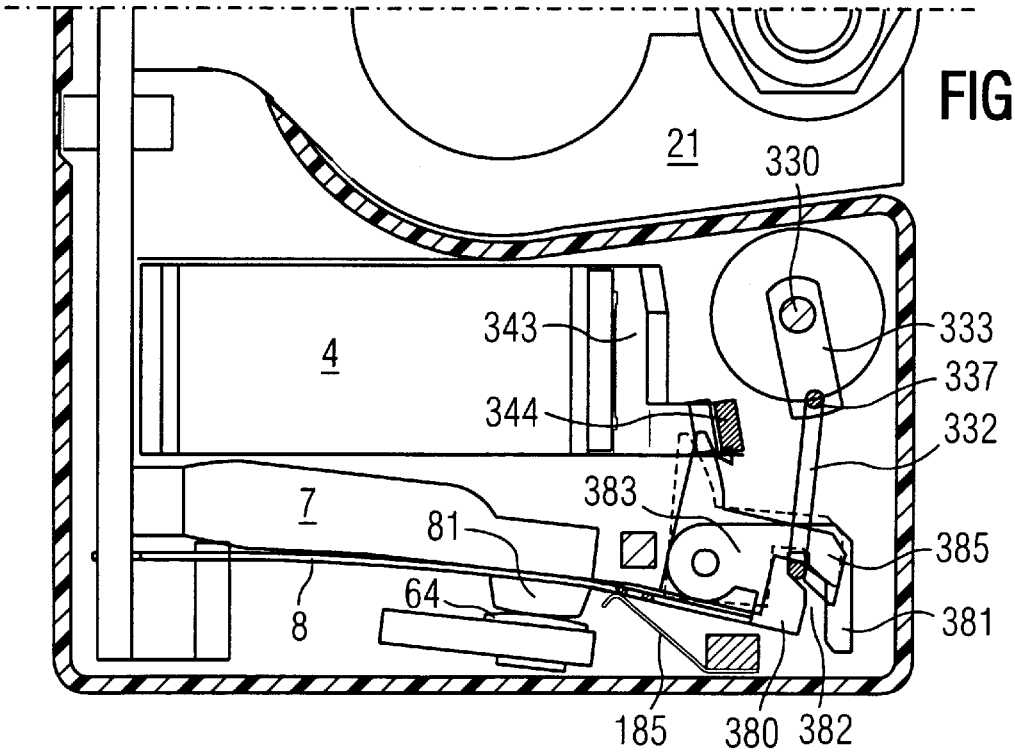
FIG. 10 is a plan view of a fourth embodiment of the battery section switch shown in quiescent position.
Figure 11:
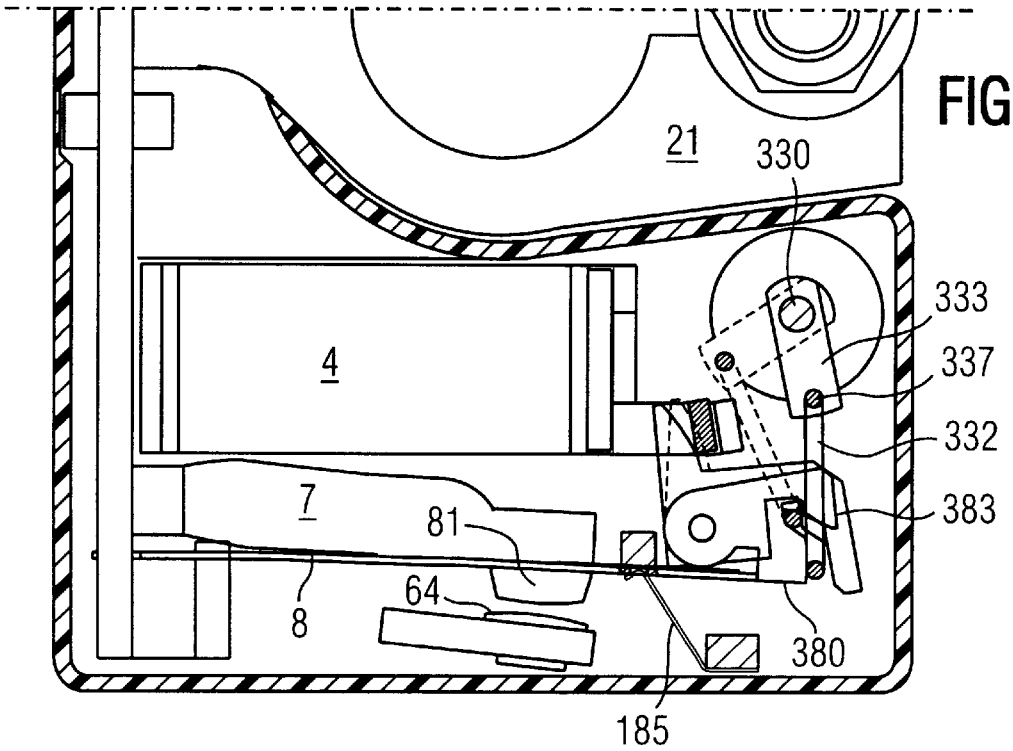
FIG. 11 is a plan view of a fourth embodiment of the battery section switch shown in triggered position.
Figure 12:
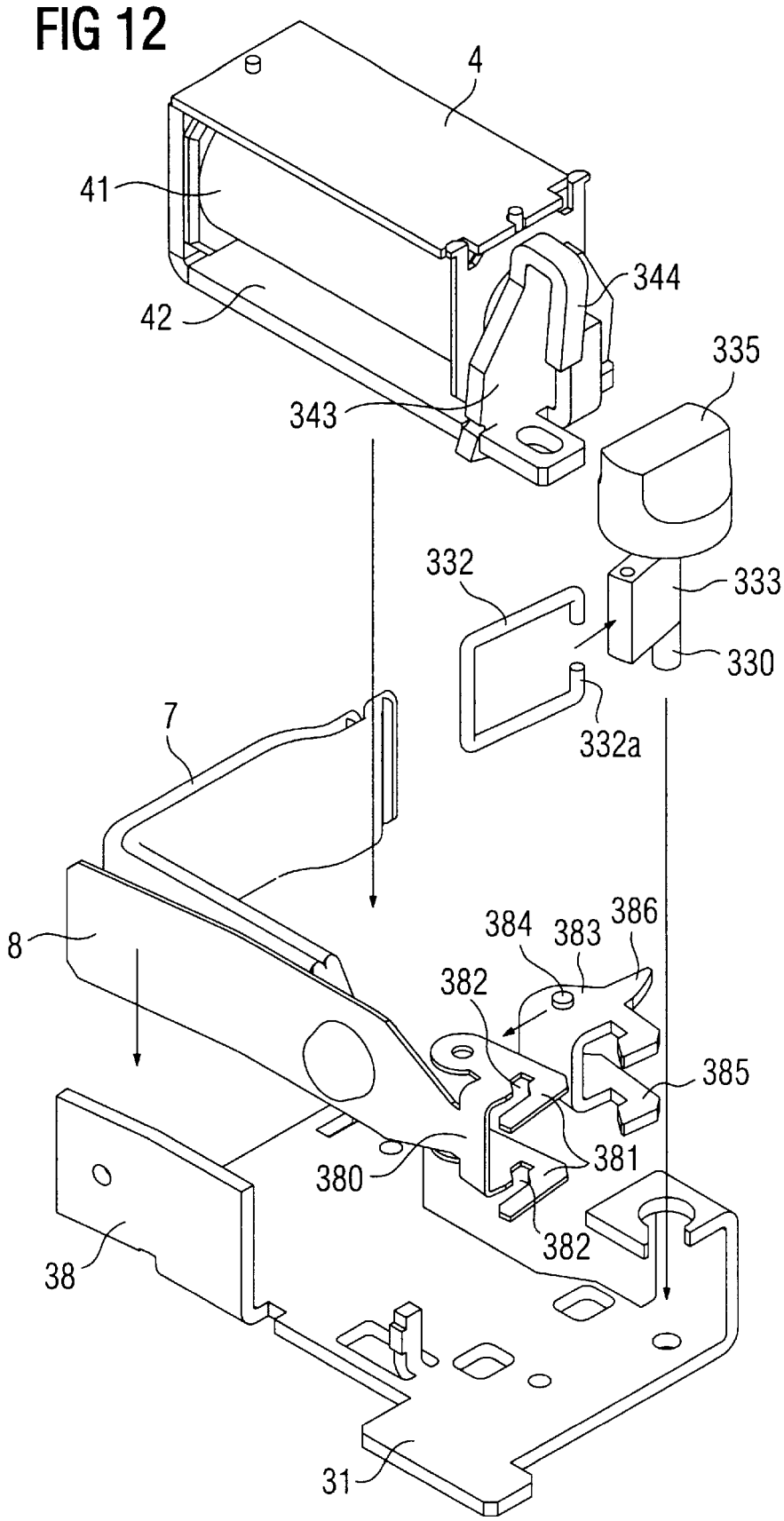
FIG. 12 is an exploded view of the spring device of the battery section switch of FIG. 10.
Figure 13:
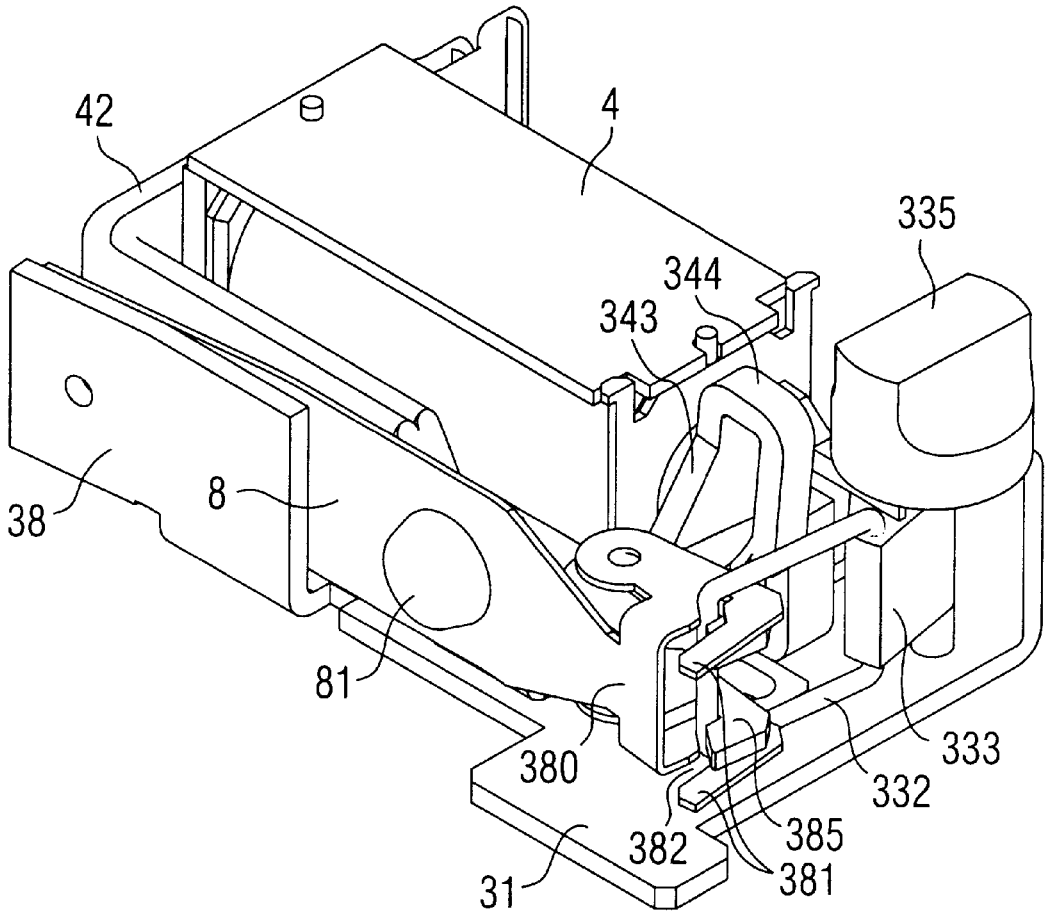
FIG. 13 is a perspective view of the spring device of FIG. 12 in the assembled condition.

FIGS. 8 and 9 show another embodiment of the toggle spring device. In this embodiment, the contact spring 8, the armature 143 with the boom 144 and the levers 132 and 133 are designed as in the preceding embodiment of FIG. 6. Differing from this previous embodiment, however, the second lever 133 is not seated rigidly relative to the plastic housing 1 but is seated on a slide 231 via a rotary coupling 230, wherein the slide 231 is in turn displaceably guided in the plastic housing 1 via a straight-line guide 232 approximately parallel to the extended axis of the toggle link. A rotary knob 235 is seated in the plastic housing 1 separately from the slide 231 and is coupled to the slide 231 in the fashion of a slider crank. To this end, the rotary knob 235 has an eccentric dog 236 that is in engagement with an oblong hole 239 of the slide.

For manual reactivation following an electrical triggering, the rotary knob 235 must be turned back in a counter clockwise direction in this case for tensing the toggle, whereby the middle toggle link 237 is pulled beyond the dead point via an additional toggle restoring spring 234 and is brought into detent against the seating edge 145. Only then is the contact spring 8 tensed by longitudinal displacement of the toggle in the guide 232 as a result of turning the rotary knob 235 forward in a clockwise direction. The fixing of the tensed condition (with closed contacts 81 and 64) is achieved by a detent of the eccentric dog 236 of the rotary knob 235 in the oblong hole 239 beyond the dead point. In this case, the manual shut-off is possible without additional measures on the basis of the slider crank articulation between the rotary knob 235 and the slide 231. The electrical triggering ensues in the same way as given the embodiment of FIG. 6.

FIGS. 10 through 13 show a fourth embodiment of the inventive battery section switch. This differs from the preceding examples essentially in that a first lever 332 has its outer end in coupling engagement with the contact spring 8. The contact spring 8 is bent U-shaped at its free end 380, whereby respective guide slots 382 for the first lever 332 of the toggle are provided in the lateral legs 381. This first lever 332 is shaped as a wire bow and has its inwardly bent ends 332*a* hooked into bores 332*a* of a second lever 333 in order to form a middle toggle link 337. The second lever 333 is rigidly connected to a rotary knob 335 that is seated in the plastic housing 1 rigidly connected to a shaft 330.

A switch pawl 383 is also seated in the free end 380 of the contact spring 8 that is bent U-shaped, being seated pivotable via bearing peg 384 that is capable of locking the first lever 332 in the guide slots 382 with locking hooks 385. This condition is shown with solid lines in FIG. 10. A boom 344 of a modified armature 343 of the electromagnet system 4 engages at an actuation nose 386 of the switch pawl 383. Upon excitation of the electromagnet system 4, the switch pawl 383 is swivelled via this boom 344 and the actuation nose 386, as a result whereof the toggle is unlocked. The free end 380 of the contact spring 8 thus releases from the toggle, so that the contacts 81 and 64 open due to the restoring force of the contact spring 8. This open condition is shown with solid lines in FIG. 11.

Even when the rotary knob 335 remains in the turn-on position in this case and, thus, the toggle continues to be tensed, the contacts 81 and 64 are opened by the responding electromagnet system 4, the short-circuit disengagement being thus assured. As long as the electromagnet system 4 is excited, the toggle can also not be locked with the contact spring 8, and a closing of the contacts 81 and 64 is thus not possible. Only when the electromagnet system 4 is no longer excited does the switch pawl 383 return into its initial position as a result of a pawl spring (not shown). This can be bent by turning the rotary knob 335, as a result whereof the first lever 332 couples into the guide slot 382 and is locked thereat. By turning the rotary knob 335 counter-clockwise, the contacts 81 and 64 can then be manually reactivated.

Figure 14:
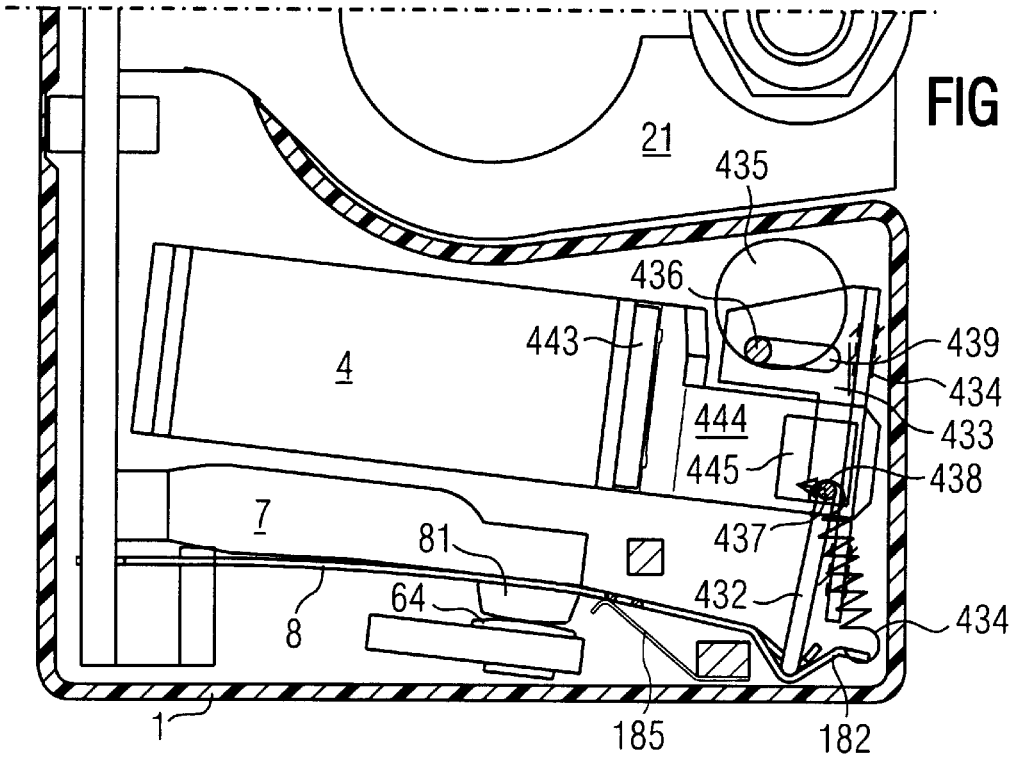
FIG. 14 is a plan view of a fifth embodiment of the battery section switch in quiescent position.
Figure 15:
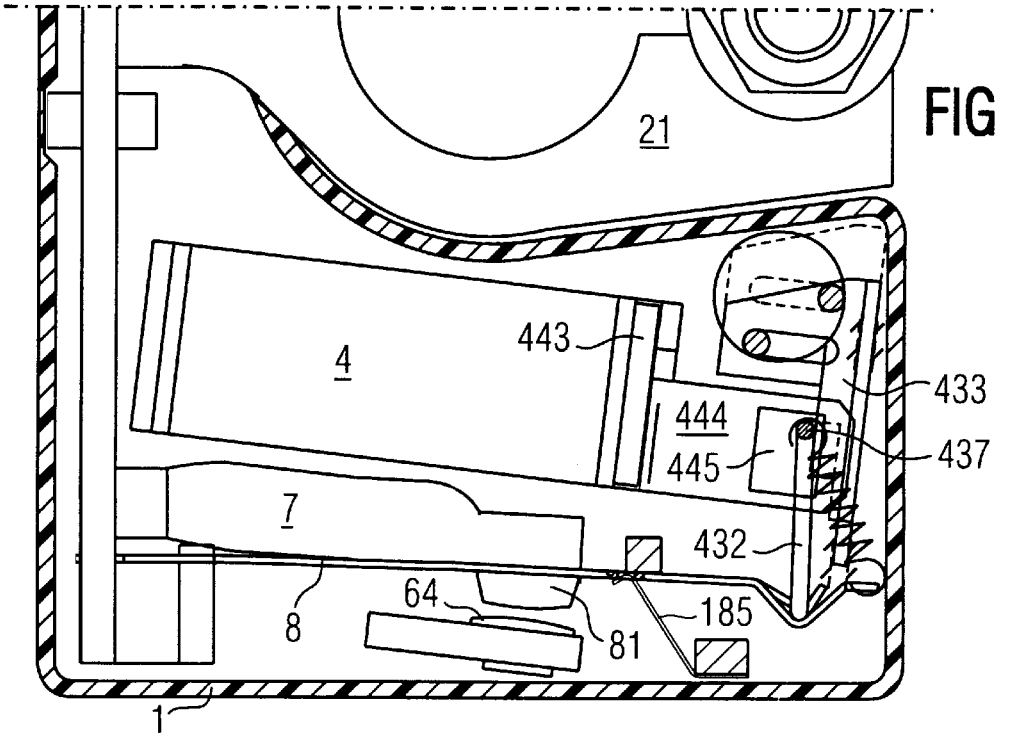
FIG. 15 is a plan view of a fifth embodiment of the battery section switch in triggered position.

FIGS. 14 and 15 show a fifth embodiment of the inventive battery section switch. In this example, the toggle spring device is modified in such a way compared to FIG. 6 that the first toggle 432 forms a middle toggle link 437 that is engaged with the second lever only in the elongated condition of the toggle, said second lever in turn being formed by a slide 433. This slide 433 is guided in the housing approximately parallel to the extending axis of the toggle link on the basis of a straight-line guide 431 and forms a latch 438 into which the middle toggle link 437 is pulled by a restoring spring 434. The slide 433 is connected via an oblong hole 439 to an eccentric dog 436 of a rigidly seated rotary knob 435 in the fashion of a slider crank as in the embodiment according to FIG. 8. When the rotary knob 435 is turned counter-clockwise, the slide 433 assumes its outer limit position (entered with broken lines in FIG. 15), so that the first lever 432 with the middle toggle link 437 engages into the latch 438 of the slide 433. By turning the rotary knob 435 in a clockwise direction, the slide 433 and, together with it, the tensed toggle link is shifted in the direction toward the contact spring 8, so that the contacts 81 and 64 are closed (position according to FIG. 14). An armature 443 of the electromagnet system 4 is fashioned such with a boom 444 in this case that the middle toggle link 437 of the first lever 432 lies in a window 445 of the boom 444. Given response of the battery section switch, i.e. given excitation of the electromagnet system 4, the armature 443 pushes the middle toggle link 437 out of the latch 438 beyond the dead point via the boom 444, as a result whereof the spring device is triggered and the contact spring 8 opens, even when the rotary knob 435 remains in the on position (FIG. 15). When the slide 433 is pushed back by turning the rotary knob 435 in a counter-clockwise direction, the first lever 432 together with the middle toggle link 437 again couples into the latch 438. Given rotation of the rotary knob 435 in a clockwise direction, the slide 433 and the first lever 432 are then again moved in the direction toward the contact spring 8, whereby the latter is tensed and the contacts 81 and 64 are closed.

Although modifications and changes may be suggested by those of ordinary skill in the art, it is the intention of the inventors to embody within the patent warranted hereon all changes and modifications as reasonably and properly come within the scope of their contribution to the art.

We claim as our invention:

1. A battery section switch for a load circuit of a vehicle battery, said battery section switch comprising:

a housing;

an electromagnet system having an armature and arranged in said housing;

an input lead adapted for connection to a terminal post of a vehicle battery;

an output lead connectable to a load circuit;

a contact carrier connected to said input lead and having a length and a movable contact, said contact carrier being switchable between an open position and a closed position and being pre-stressed into said open position by spring power;

a stationary contact connected to said output lead and in contact with said movable contact when said contact carrier is in said closed position, to produce a switched connection between said input lead and said output lead; and a toggle spring device having a first lever attached to said contact carrier and having a second lever seated in said housing that are connected to form a toggle via a middle toggle link, said toggle being coupled to said armature and locking said contact carrier in said closed position in an approximately stretched condition of said toggle, upon excitation of said electromagnet system, said armature releasing said locking between said toggle and said contact carrier, and said contact carrier comprising an elongated contact spring having a first end clamped only to said housing and having a second end engaging an outer end of said first lever to form a rotary coupling, and said movable contact being carried in a middle region along said contact carrier length.

2. The battery section switch according to claim 1, wherein said free end of said contact spring comprises a hook and said outer end of said first lever comprises an eyelet, said hook engaging said eyelet.

3. The battery section switch according to claim 1, wherein said free end of said contact spring comprises an indented portion in which said outer end of said first lever is seated.

4. The battery section switch according to claim 1, wherein said armature of said electromagnet system acts on said middle toggle link approximately perpendicularly to an extended axis of said toggle via an actuation arm and pulls said middle toggle link beyond a dead point given excitation of said electromagnet system.

5. The battery section switch according to claim 4, wherein said actuation arm is a hook-shaped boom of said armature.

6. The battery section switch according to claim 4, wherein said actuation arm is a crimped setting wire attached to said armature and at said middle toggle link in articulated fashion.

7. The battery section switch according to claim 1, further comprising a supporting spring attached to said contact carrier and locking said contact carrier in said open position, said locking being overcome only by said toggle spring device given a predetermined closing force to suddenly close said movable contact to said stationary contact.

8. The battery section switch according to claim 1, further comprising a rotatably seated supporting lever latched to said contact carrier in said open position and locking said contact carrier in said open position until said first end of said contact carrier releases said supporting lever from said interlock given a predetermined sag, wherein said movable contact is closed to said stationary contact.

9. The battery section switch according to claim 1, further comprising a shut-off key seated in said housing and attached to said middle toggle link, wherein a user can actuate said shut-off key to manually set the contact carrier to said open position.

10. The battery section switch according to claim 1, wherein said second lever is seated on an angular articulated peg comprising a bent leg of a spring device plate made of sheet metal.

11. The battery section switch according to claim 1, wherein said first lever and said second lever are sheet metal and are connected by articulated pegs to form said middle toggle link.

12. The battery section switch according to claim 10, wherein an outer end of said second lever extends beyond a point where said second lever is seated rigidly relative to said housing to form a switch, wherein said switch is accessible through an opening in said housing opening for manual actuation.

13. The battery section switch according to claim 10, further comprising a rotary knob seated concentric to an outer end of said second toggle link lever, said rotary knob comprising at least one eccentric dog attached to said second lever, wherein rotation of said rotary knob actuates said toggle to said closed position and to said open position.

14. The battery section switch according to claim 1, wherein said rotary coupling is a first rotary coupling, wherein said second lever is seated on a slide via a displaceable, second rotary coupling, said slide being in turn guided in said housing displaceable parallel to an extending axis of said middle toggle link, said slide being coupled via an oblong hole to an eccentric dog of a rotary knob seated rigidly relative to said housing and being locked by said eccentric dog in an extended position of said middle toggle link.

15. The battery section switch according to claim 1, wherein said second end of said contact carrier is releasably coupled to said outer end of said first lever, and further comprising a switch pawl rotatably seated on said contact spring and locking said first lever to said contact spring under spring pre-stress, and wherein said second lever is rotatably seated fixed to said housing and is connected to a manual actuation element, and wherein said armature engages said switch pawl wherein upon excitation of said electromagnet system said contact carrier moves to said open position.

16. The battery section switch according to claim 1, wherein said second lever is a slide guided straight-line in said housing, and further comprising a rotary element seated rigidly relative to said housing and having an eccentric dog engaging into an oblong hole of said slide enabling rotation of said rotary element and displacement in a direction of said guide, and wherein said first lever and said middle toggle link is latched into a latch at said slide by a restoring spring, and wherein said middle toggle link is moved out of said latch by said armature upon excitation of said electromagnet system.

* * * * *